US009410319B2

(12) United States Patent
Ziegler et al.

(10) Patent No.: US 9,410,319 B2
(45) Date of Patent: Aug. 9, 2016

(54) HEAT AND PRESSURE GENERATED DESIGN

(71) Applicant: VALINGE INNOVATION AB, Viken (SE)

(72) Inventors: Goran Ziegler, Viken (SE); Kent Lindgren, Perstorp (SE)

(73) Assignee: VALINGE INNOVATION AB, Viken (SE)

( * ) Notice: Subject to any disclaimer, the term of this patent is extended or adjusted under 35 U.S.C. 154(b) by 0 days.

(21) Appl. No.: 14/184,299

(22) Filed: Feb. 19, 2014

(65) Prior Publication Data

US 2014/0171554 A1 Jun. 19, 2014

Related U.S. Application Data

(62) Division of application No. 12/976,213, filed on Dec. 22, 2010, now abandoned.

(60) Provisional application No. 61/295,550, filed on Jan. 15, 2010.

(51) Int. Cl.

| | |
|---|---|
| ***E04C 2/24*** | (2006.01) |
| ***B44C 5/04*** | (2006.01) |
| ***E04F 13/08*** | (2006.01) |

(52) U.S. Cl.

CPC ..... *E04C 2/246* (2013.01); *B44C 5/0476* (2013.01); *E04F 13/0871* (2013.01); *Y10T 428/24995* (2015.04); *Y10T 428/249924* (2015.04)

(58) Field of Classification Search

None

See application file for complete search history.

(56) References Cited

U.S. PATENT DOCUMENTS

| | | | |
|---|---|---|---|
| 2,587,064 | A | 2/1952 | Rapson |
| 2,831,793 | A | 4/1958 | Elmendorf |
| 2,962,081 | A | 11/1960 | Dobry et al. |
| 3,032,820 | A | 5/1962 | Johnson |
| 3,135,643 | A | 6/1964 | Michl |
| 3,286,006 | A | 11/1966 | Annand |
| 3,308,013 | A | 3/1967 | Bryant |
| 3,325,302 | A | 6/1967 | Hosfeld |
| 3,342,621 | A | 9/1967 | Point et al. |
| 3,345,234 | A | 10/1967 | Jecker et al. |
| 3,426,730 | A | 2/1969 | Lawson et al. |

(Continued)

FOREIGN PATENT DOCUMENTS

| | | |
|---|---|---|
| AU | 80284/75 | 6/1975 |
| CA | 2 557 096 A1 | 7/2005 |

(Continued)

OTHER PUBLICATIONS

Lindgren, Kent, et al., U.S. Appl. No. 14/321,288, entitled "A Method of Manufacturing Panel and a Building Panel," filed Jul. 1, 2014.

(Continued)

*Primary Examiner* — Elizabeth A Quast
*Assistant Examiner* — Kyle Walraed-Sullivan
(74) *Attorney, Agent, or Firm* — Buchanan Ingersoll & Rooney P.C.

(57) ABSTRACT

A wood fiber based panel with surfaces layer with lower parts which has less binders than the upper parts. Also, a method of manufacturing a building panel having a structured surface with a design that has color variation in register with the structure obtained by a varying pressure distribution applied on the surface.

19 Claims, 2 Drawing Sheets

(56) References Cited

U.S. PATENT DOCUMENTS 3,463,653 A 8/1969 Letter
3,486,484 A 12/1969 Bullough
3,533,725 A 10/1970 Bridgeford
3,540,978 A * 11/1970 Ames ..... 428/325
3,565,665 A 2/1971 Stranch et al.
3,673,020 A 6/1972 De Jaeger
3,846,219 A 11/1974 Kunz
3,880,687 A 4/1975 Elmendorf et al.
3,897,185 A 7/1975 Beyer
3,897,588 A 7/1975 Nohtomi
3,914,359 A 10/1975 Bevan
3,961,108 A 6/1976 Rosner et al.
4,052,739 A 10/1977 Wada et al.
4,093,766 A 6/1978 Scher et al.
4,131,705 A 12/1978 Kubinsky
4,255,480 A 3/1981 Scher
4,313,857 A 2/1982 Blount
4,337,290 A 6/1982 Kelly et al.
4,420,525 A * 12/1983 Parks ..... 428/156
4,430,375 A 2/1984 Scher et al.
4,474,920 A * 10/1984 Kyminas et al. ..... 524/386
4,890,656 A 1/1990 Ohsumi et al.
5,034,272 A 7/1991 Lindgren et al.
5,134,026 A 7/1992 Melcher
5,206,066 A 4/1993 Horacek
5,246,765 A 9/1993 Lussi et al.
5,258,216 A 11/1993 Von Bonin et al.
5,266,384 A 11/1993 O'Dell
5,314,554 A * 5/1994 Owens ..... 156/154
5,422,170 A 6/1995 Iwata et al.
5,466,511 A 11/1995 O'Dell et al.
5,543,193 A 8/1996 Tesch
5,569,424 A 10/1996 Amour
5,601,930 A 2/1997 Mehta et al.
5,604,025 A 2/1997 Tesch
5,609,966 A 3/1997 Perrin et al.
5,766,522 A 6/1998 Daly et al.
5,827,788 A * 10/1998 Miyakoshi ..... 442/164
5,855,832 A 1/1999 Clausi
5,865,003 A * 2/1999 Klett ..... D06N 5/00 156/62.2
5,891,564 A 4/1999 Schultz et al.
5,925,296 A 7/1999 Leese
5,942,072 A 8/1999 McKinnon
6,036,137 A 3/2000 Myren
6,103,377 A 8/2000 Clausi
6,238,750 B1 * 5/2001 Correll et al. ..... 427/521
6,468,645 B1 10/2002 Clausi
6,521,326 B1 2/2003 Fischer et al.
6,537,610 B1 3/2003 Springer et al.
6,620,349 B1 * 9/2003 Lopez ..... 252/607
6,666,951 B1 12/2003 Kostiw
6,769,217 B2 8/2004 Nelson
6,773,799 B1 8/2004 Persson et al.
6,803,110 B2 10/2004 Drees et al.
6,926,954 B2 8/2005 Shuren et al.
6,991,830 B1 1/2006 Hansson et al.
7,022,756 B2 4/2006 Singer
7,485,693 B2 2/2009 Matsuda et al.
7,811,489 B2 10/2010 Pervan
8,349,234 B2 1/2013 Ziegler et al.
8,349,235 B2 1/2013 Pervan et al.
8,419,877 B2 4/2013 Pervan et al.
8,431,054 B2 4/2013 Pervan et al.
8,480,841 B2 7/2013 Pervan et al.
8,481,111 B2 7/2013 Ziegler et al.
8,617,439 B2 12/2013 Pervan et al.
8,663,785 B2 3/2014 Ziegler et al.
8,728,564 B2 5/2014 Ziegler et al.
8,784,587 B2 7/2014 Lindgren et al.
8,920,874 B2 12/2014 Ziegler et al.
8,920,876 B2 12/2014 Vetter et al.
8,993,049 B2 3/2015 Pervan
9,085,905 B2 7/2015 Persson et al.
9,181,698 B2 11/2015 Pervan et al.
9,255,405 B2 2/2016 Pervan et al.
9,296,191 B2 3/2016 Pervan et al.
2001/0006704 A1 7/2001 Chen et al.
2001/0009309 A1 7/2001 Taguchi et al.
2002/0054994 A1 5/2002 Dupre et al.
2002/0100231 A1 8/2002 Miller
2002/0155297 A1 10/2002 Shuren
2003/0056873 A1 3/2003 Nakos et al.
2003/0059639 A1 3/2003 Worsley
2003/0102094 A1 6/2003 Tirri et al.
2003/0129361 A1 7/2003 Plug
2003/0208980 A1 11/2003 Miller et al.
2004/0123542 A1 7/2004 Grafenauer
2004/0191547 A1 9/2004 Oldorff
2004/0202857 A1 10/2004 Singer
2004/0206036 A1 10/2004 Pervan
2004/0237436 A1 12/2004 Zuber et al.
2004/0247831 A1 12/2004 Nakagawa
2004/0250911 A1 12/2004 Vogel
2005/0003099 A1 1/2005 Quist
2005/0079780 A1 4/2005 Rowe et al.
2005/0193677 A1 9/2005 Vogel
2005/0252130 A1 11/2005 Martensson
2006/0008630 A1 1/2006 Thiers et al.
2006/0024465 A1 2/2006 Briere
2006/0032175 A1 2/2006 Chen et al.
2006/0070321 A1 4/2006 Au
2006/0145384 A1 7/2006 Singer
2006/0182938 A1 8/2006 Oldorff
2006/0183853 A1 8/2006 Sczepan
2007/0055012 A1 3/2007 Caldwell
2007/0066176 A1 * 3/2007 Wenstrup et al. ..... 442/415
2007/0166516 A1 7/2007 Kim et al.
2007/0184244 A1 8/2007 Doehring
2007/0207296 A1 9/2007 Eisermann
2007/0218260 A1 9/2007 Miclo et al.
2007/0224438 A1 9/2007 Van Benthem et al.
2007/0256804 A1 11/2007 Garcis Espino et al.
2008/0000417 A1 1/2008 Pervan et al.
2008/0032120 A1 2/2008 Braun
2008/0090032 A1 4/2008 Perrin et al.
2008/0176039 A1 7/2008 Chen et al.
2008/0263985 A1 10/2008 Hasch et al.
2009/0056257 A1 * 3/2009 Mollinger et al. ..... 52/314
2009/0124704 A1 5/2009 Jenkins
2009/0135356 A1 * 5/2009 Ando ..... 349/137
2009/0139170 A1 * 6/2009 Thiers ..... 52/309.1
2009/0145066 A1 6/2009 Pervan
2009/0155612 A1 * 6/2009 Pervan et al. ..... 428/498
2009/0208646 A1 8/2009 Kreuder et al.
2009/0294037 A1 12/2009 Oldorff
2009/0311433 A1 12/2009 Wittmann
2010/0092731 A1 4/2010 Pervan et al.
2010/0196678 A1 8/2010 Vermeulen
2010/0223881 A1 9/2010 Kalwa
2010/0239820 A1 9/2010 Buhlmann
2010/0291397 A1 11/2010 Pervan et al.
2010/0300030 A1 * 12/2010 Pervan et al. ..... 52/588.1
2010/0307675 A1 12/2010 Buhlmann
2010/0307677 A1 12/2010 Buhlmann
2010/0319282 A1 12/2010 Ruland
2010/0323187 A1 * 12/2010 Kalwa ..... B32B 33/00 428/325
2010/0330376 A1 12/2010 Trksak
2011/0175251 A1 7/2011 Ziegler et al.
2011/0177319 A1 7/2011 Ziegler et al.
2011/0177354 A1 7/2011 Ziegler et al.
2011/0189448 A1 8/2011 Lindgren et al.
2011/0189471 A1 8/2011 Ziegler
2011/0247748 A1 10/2011 Pervan et al.
2011/0250404 A1 10/2011 Pervan et al.
2011/0262720 A1 * 10/2011 Riebel et al. ..... 428/195.1
2011/0283642 A1 11/2011 Meirlaen et al.
2011/0283650 A1 11/2011 Pervan et al.
2011/0293823 A1 12/2011 Bruderer et al.
2011/0293906 A1 12/2011 Jacobsson
2012/0263878 A1 10/2012 Ziegler et al.
2012/0263965 A1 10/2012 Persson et al.
2012/0264853 A1 10/2012 Ziegler et al.

(56) References Cited

U.S. PATENT DOCUMENTS

| | | | |
|---|---|---|---|
| 2012/0288689 | A1 | 11/2012 | Hansson et al. |
| 2012/0308774 | A1 | 12/2012 | Persson et al. |
| 2013/0092314 | A1 | 4/2013 | Ziegler et al. |
| 2013/0095315 | A1 | 4/2013 | Pervan et al. |
| 2013/0111845 | A1 | 5/2013 | Pervan et al. |
| 2013/0189534 | A1 | 7/2013 | Pervan et al. |
| 2013/0269863 | A1 | 10/2013 | Pervan et al. |
| 2013/0273244 | A1 | 10/2013 | Vetter et al. |
| 2013/0273245 | A1 | 10/2013 | Ziegler et al. |
| 2014/0044872 | A1 | 2/2014 | Pervan |
| 2014/0075874 | A1 | 3/2014 | Pervan et al. |
| 2014/0178630 | A1 | 6/2014 | Pervan et al. |
| 2014/0186610 | A1 | 7/2014 | Pervan |
| 2014/0199558 | A1 | 7/2014 | Pervan et al. |
| 2014/0234531 | A1 | 8/2014 | Ziegler et al. |
| 2015/0017461 | A1 | 1/2015 | Lindgren et al. |
| 2015/0079280 | A1 | 3/2015 | Vetter et al. |
| 2015/0093502 | A1 | 4/2015 | Ziegler et al. |
| 2015/0111055 | A1 | 4/2015 | Persson et al. |
| 2015/0159382 | A1 | 6/2015 | Pervan |
| 2015/0197942 | A1 | 7/2015 | Pervan et al. |
| 2015/0197943 | A1 | 7/2015 | Ziegler et al. |
| 2015/0275526 | A1 | 10/2015 | Persson et al. |
| 2015/0298433 | A1 | 10/2015 | Kalwa |
| 2016/0031189 | A1 | 2/2016 | Pervan et al. |

FOREIGN PATENT DOCUMENTS

| | | | |
|---|---|---|---|
| CH | 298894 | A | 5/1954 |
| DE | 1 815 312 | A1 | 7/1969 |
| DE | 7148789 | U | 4/1972 |
| DE | 29 39 828 | A1 | 4/1981 |
| DE | 33 34 921 | A1 | 4/1985 |
| DE | 42 36 266 | A1 | 5/1993 |
| DE | 202 14 532 | U1 | 2/2004 |
| DE | 103 31 657 | A1 | 2/2005 |
| DE | 20 2004 003 061 | U1 | 7/2005 |
| DE | 10 2004 050 278 | A1 | 4/2006 |
| DE | 20 2006 007 797 | U1 | 8/2006 |
| DE | 10 2005 046 264 | A1 | 4/2007 |
| DE | 10 2006 024 593 | A1 | 12/2007 |
| EP | 0 129 430 | A2 | 12/1984 |
| EP | 0 129 430 | B1 | 1/1990 |
| EP | 0 355 829 | A2 | 2/1990 |
| EP | 0 611 408 | A1 | 12/1993 |
| EP | 0 592 013 | A2 | 4/1994 |
| EP | 0 656 443 | A1 | 6/1995 |
| EP | 0 611 408 | B1 | 9/1996 |
| EP | 0 732 449 | A1 | 9/1996 |
| EP | 0 744 477 | A2 | 11/1996 |
| EP | 0 914 914 | A2 | 5/1999 |
| EP | 0 732 449 | B1 | 8/1999 |
| EP | 0 744 477 | B1 | 1/2000 |
| EP | 1 035 255 | A1 | 9/2000 |
| EP | 1 125 971 | A1 | 8/2001 |
| EP | 1 136 251 | A2 | 9/2001 |
| EP | 1 193 288 | A1 | 4/2002 |
| EP | 1 209 199 | A1 | 5/2002 |
| EP | 1 242 702 | A1 | 9/2002 |
| EP | 1 249 322 | A1 | 10/2002 |
| EP | 1 454 763 | A2 | 9/2004 |
| EP | 1 242 702 | B1 | 11/2004 |
| EP | 1 498 241 | A2 | 1/2005 |
| EP | 1 507 664 | A1 | 2/2005 |
| EP | 1 507 664 | B1 | 2/2005 |
| EP | 1 584 378 | A1 | 10/2005 |
| EP | 1 681 103 | A2 | 7/2006 |
| EP | 1 690 603 | A1 | 8/2006 |
| EP | 1 847 385 | A1 | 10/2007 |
| EP | 1 961 556 | A1 | 8/2008 |
| EP | 1 985 464 | A1 | 10/2008 |
| EP | 1 997 623 | A1 | 12/2008 |
| EP | 2 025 484 | A1 | 2/2009 |
| EP | 1 454 763 | B1 | 8/2009 |
| EP | 2 105 320 | A1 | 9/2009 |
| EP | 2 106 903 | A1 | 10/2009 |
| EP | 2 213 476 | A1 | 8/2010 |
| EP | 2 226 201 | A1 | 9/2010 |
| EP | 2 246 500 | A2 | 11/2010 |
| EP | 2 264 259 | A2 | 12/2010 |
| FR | 2 873 953 | A1 | 2/2006 |
| GB | 984 170 | A | 2/1965 |
| GB | 1090450 | | 11/1967 |
| GB | 2 248 246 | A | 4/1992 |
| JP | 2-229002 | A | 9/1990 |
| JP | 11-291203 | A | 10/1999 |
| JP | 2001-287208 | A | 10/2001 |
| JP | 2003-311717 | A | 11/2003 |
| JP | 2003-311718 | A | 11/2003 |
| JP | 2005-034815 | A | 2/2005 |
| JP | 2005-074682 | A | 3/2005 |
| JP | 2005-170016 | A | 6/2005 |
| JP | 2005-219215 | A | 8/2005 |
| JP | 3705482 | B2 | 10/2005 |
| JP | 2005-307582 | A | 11/2005 |
| JP | 2007-216692 | A | 8/2007 |
| JP | 2007-268843 | A | 10/2007 |
| JP | 2008-188826 | A | 8/2008 |
| NZ | 225556 | A1 | 2/1992 |
| SE | 469 326 | B | 6/1993 |
| WO | WO 89/03753 | A1 | 5/1989 |
| WO | WO 92/06832 | A1 | 4/1992 |
| WO | WO 93/24295 | A1 | 12/1993 |
| WO | WO 93/24296 | A1 | 12/1993 |
| WO | WO 94/00280 | A1 | 1/1994 |
| WO | WO 95/06568 | A1 | 3/1995 |
| WO | WO 00/22225 | A1 | 4/2000 |
| WO | WO 00/44576 | A1 | 8/2000 |
| WO | WO 01/00409 | A1 | 1/2001 |
| WO | WO 01/48333 | A1 | 7/2001 |
| WO | WO 01/64408 | A1 | 9/2001 |
| WO | WO 01/68367 | A1 | 9/2001 |
| WO | WO 01/92037 | A2 | 12/2001 |
| WO | WO 02/42167 | A2 | 5/2002 |
| WO | WO 02/42373 | A1 | 5/2002 |
| WO | WO 03/078761 | A1 | 9/2003 |
| WO | WO 03/095202 | A1 | 11/2003 |
| WO | WO 2004/042168 | A1 | 5/2004 |
| WO | WO 2004/050359 | A1 | 6/2004 |
| WO | WO 2004/067874 | A2 | 8/2004 |
| WO | WO 2005/054600 | A1 | 6/2005 |
| WO | WO 2005/066431 | A2 | 7/2005 |
| WO | WO 2005/080096 | A2 | 9/2005 |
| WO | WO 2005/097874 | A2 | 10/2005 |
| WO | WO 2005/116337 | A1 | 12/2005 |
| WO | WO 2005/116361 | A1 | 12/2005 |
| WO | WO 2006/007413 | A1 | 1/2006 |
| WO | WO 2006/013469 | A1 | 2/2006 |
| WO | WO 2006/015313 | A2 | 2/2006 |
| WO | WO 2006/042651 | A1 | 4/2006 |
| WO | WO 2006/043893 | A1 | 4/2006 |
| WO | WO 2006/066776 | A2 | 6/2006 |
| WO | WO 2006/126930 | A1 | 11/2006 |
| WO | WO 2007/015669 | A2 | 2/2007 |
| WO | WO 2007/042258 | A1 | 4/2007 |
| WO | WO 2007/059294 | A2 | 5/2007 |
| WO | WO 2008/004960 | A2 | 1/2008 |
| WO | WO 2008/004960 | A8 | 1/2008 |
| WO | WO 2008/148771 | A1 | 12/2008 |
| WO | WO 2009/065768 | A1 | 5/2009 |
| WO | WO 2009/065769 | A2 | 5/2009 |
| WO | WO 2009/065769 | A3 | 5/2009 |
| WO | WO 2009/080772 | A1 | 7/2009 |
| WO | WO 2009/080813 | A1 | 7/2009 |
| WO | WO 2009/116926 | A1 | 9/2009 |
| WO | WO 2009/124704 | A1 | 10/2009 |
| WO | WO 2010/084466 | A2 | 7/2010 |
| WO | WO 2010/087752 | A1 | 8/2010 |
| WO | WO 2010/094500 | A1 | 8/2010 |
| WO | WO 2011/087422 | A1 | 7/2011 |
| WO | WO 2011/087423 | A1 | 7/2011 |

(56) References Cited

FOREIGN PATENT DOCUMENTS

| | | | |
|---|---|---|---|
| WO | WO 2011/129757 | A1 | 10/2011 |
| WO | WO 2011/141851 | A2 | 11/2011 |
| WO | WO 2012/004699 | A2 | 1/2012 |

OTHER PUBLICATIONS

Le Fur, X., et al., "Recycling melamine-impregnated paper waste as board adhesives," published online Oct. 26, 2004, pp. 419-423, vol. 62, Springer-Verlag, DE.
Odian, George, "Principles of Polymerization," 1991, 3rd Edition, 5 pages incl. pp. 122-123, John Wiley & Sons, Inc., New York, NY, USA.
Persson, Hans, et al., U.S. Appl. No. 14/516,957, entitled "Method of Manufacturing a Building Panel," filed Oct. 17, 2014.
Vetter, Georg, et al., U.S. Appl. No. 14/553,196, entitled "Method for Producing a Building Panel," filed Nov. 25, 2014.
Ziegler, Göran, et al., U.S. Appl. No. 14/563,167, entitled "Bright Coloured Surface Layer," filed Dec. 8, 2014.
Kalwa, Norbert, U.S. Appl. No. 14/789,339 entitled "Panel, Use of a Panel, Method for Manufacturing a Panel and a Prepreg," filed Jul. 1, 2015.
Pervan, Darko, et al., U.S. Appl. No. 14/980,638 entitled "Wood Fibre Based Panels with a Thin Surface Layer," filed Dec. 28, 2015.
Pervan, Darko, et al., U.S. Appl. No. 15/061,303 entitled "Powder Overlay," filed Mar. 4, 2016.
"Hex Netting—Fencing—Ace Hardware," from http://www.acehardware.com/family/index.jsp?categoryId=1260278, archived on Nov. 1, 2009, accessed through the Internet Archive, WaybackMachine, 3 pages.
International Search Report (Form PCT/ISA/210) issued in corresponding PCT/SE2010/051475, Apr. 20, 2011, 4 pages, ISA/Swedish Patent Office, Stockholm, SE.
Parquet International, "Digital Printing is still an expensive process," Mar. 2008, cover page/pp. 78-79, www.parkettmagazin.com.
Floor Daily, "Shaw Laminates: Green by Design," Aug. 13, 2007, 1 pg, Dalton, GA.
Engstrand, Ola (Contact)/Valinge Innovation, Technical Disclosure entitled "Fibre Based Panels With a Wear Resistance Surface," Nov. 17, 2008, IP.com No. IPCOM000176590D, IP.com PriorArtDatabase, 76 pages.
Engstrand, Ola (Contact)/Valinge Innovation, Technical Disclosure entitled "WFF Embossing," May 15, 2009, IP.com No. IPCOM000183105D, IP.com PriorArtDatabase, 36 pages.
BTLSR Toledo, Inc. website. http://www.bltresins.com/more.html. "Advantages to Using Powdered Resins," May 26, 2007, 2 pages, per the Internet Archive WayBackMachine.
Nimz, H.H., "Wood," Ullmann's Encyclopedia of Industrial Chemistry, published online Jun. 15, 2000, pp. 453-505, vol. 39, Wiley-VCH Verlag GmbH & Co. KGaA, Weinheim, DE.
Pervan, Darko, et al., U.S. Appl. No. 14/151,973, entitled "Method of Producing a Building Panel and a Building Panel," Jan. 10, 2014.
Pervan, Darko, U.S. Appl. No. 14/237,617, entitled "Panel Coating," filed Feb. 7, 2014.
Pervan, Darko, et al., U.S. Appl. No. 14/192,169, entitled "Fibre Based Panels with a Wear Resistance Surface", filed Feb. 27, 2014.
Ziegler, Göran, et al., U.S. Appl. No. 14/247,839, entitled A Powder Mix and a Method for Producing a Building Panel, filed Apr. 8, 2014.

* cited by examiner

HEAT AND PRESSURE GENERATED DESIGN

CROSS REFERENCE TO RELATED APPLICATIONS

The present application is a divisional of U.S. application Ser. No. 12/976,213, filed on Dec. 22, 2010, which claims the benefit of U.S. Provisional Application No. 61/295,520, filed on Jan. 15, 2010, and claims the benefit of Swedish Application No. 1050040-3, filed on Jan. 15, 2010. The entire contents of each of U.S. application Ser. No. 12/976,213, U.S. Provisional Application No. 61/295,520 and Swedish Application No. 1050040-3 are hereby incorporated herein by reference.

TECHNICAL FIELD

The disclosure generally relates to the field of fibre-based panels with wear resistant surfaces for building panels, preferably floor panels. The disclosure relates to building panels with such wear resistance surface and to production methods to produce such panels.

BACKGROUND

Laminate flooring typically consists of layers of different materials that are compressed under heat to form a laminated board. The typical layers are an aluminum oxide containing melamine resin impregnated alfa cellulose paper, a melamine resin impregnated printed decorative paper, a wood fibre based carrier board (HDF) and a melamine resin impregnated balancing paper. Product designs are typically made by embossing the laminated product with a structured plate or paper during the press operation, and by printing the decorative paper with different designs and colors. At typical process conditions the depth of the structuration is typically less than 0.2 mm in order to yield proper looking products. Deeper structures tend to give crazing of the surface due to insufficient pressure in parts of the board area and the limitation of stretching of the paper layers. In order to give an even more natural looking product, the printed paper and the embossed structure can be coordinated giving products that are known in the field as embossed in register (EIR).

Wood Fibre Floor (WFF) is a new type of flooring product, disclosed in WO2009/065769, the entire contents of which are hereby incorporated by reference, that includes one or more layers of substantially homogenous powder mixtures that are heat compressed in processes akin to the processes used for making laminate floors. The homogenous powder mixtures typically include fibres such as wood fibres, polymer, such as melamine formaldehyde resin, hard particles, such as aluminum oxide particles and decorative materials, such as pigment particles, minerals and fibres. WFF products have a benefit over laminate floors as no papers with limited stretch capability are present, thus very deep structures can be made without yielding the observed crazing of the surface. While under heated compression the WFF powder mixture is almost liquid like in the sense that the composition flows under pressure to fill out the crevices in the structure.

SUMMARY OF THE INVENTION

In WFF, just as in laminate flooring, it is of great interest to make natural looking products by having for example products that have color variations matching the structure variation. It has surprisingly been found that such products can be obtained in WFF by heat and pressure variations, giving the possibility to tailor the design in a controlled manner. Several methods to control the design are disclosed below.

By applying a pressure with an uneven distribution over the surface of a layer and given a fluidity of the layer, when the pressure is applied, which is sufficiently high, it is possible to cause parts of the composition in the layer to be displaced to the desired location. The fluidity can be increased by, for example, increasing the amount of the binder in the surface layer. The binder is preferably a melamine resin but other resins and binders may also be used.

This makes it possible to create and control the colour variation and match it with structure variations.

Control by formulation—By controlling the composition of the WFF powder mixture, such as the amount and/or type of polymer resin, such as melamine resin, the fluidity of the composition can be controlled to give more or less pressure difference (and thus more or less displacement) in the different parts of the surface during heat compression. Compositions giving a low pressure difference over the surface cause the substantially homogenous powder mixture to stay substantially homogenous giving a homogenous coloration over the surface. Compositions giving a higher pressure difference restrict the bulk powder fluidity and the homogeneity of the mixture will then be broken as the more fluid parts of the composition partially flow away. The result is a gradient of composition over the surface area. Thus, a color variation can be attained or avoided depending on the preference of the producer.

Other ways to change the fluidity of the composition is to alter the amount and/or type of fiber, use of processing aids such as plasticizers, solvents, reactive solvents and the like.

Control by heat—The typical WFF formulation consists partially of wood fibres. Such wood fibres are prone to darkening upon heating. By applying more or less heat over the surface the coloration can be controlled.

Control by pressure—Controlling the applied pressure in the heat-compressed state can also control the color difference. At higher pressure the bulk powder fluidity is restricted so the homogeneity of the powder mixture will be broken as described above to give a gradient in composition over the surface area.

Control by press plate design—By optimizing the surface area of the structure plate or paper, increased and/or decreased flow can be controlled, thus aiding in the control of color difference over the surface area.

Control by scattering, heterogeneous scattering—WFF powder can be scattered in a heterogeneous (non-uniform) way in order to provoke pressure difference over the surface area when the product is heat compressed. This can be sought after to make a local reinforcement such as in the parts of the board in which a locking element can be positioned. In such a case, the mechanical, chemical and water resistance can be optimized in the areas of the locking system that can be subjected to moisture, cleaning agents and mechanical wear.

Heterogeneous scattering can also be made to follow the structuration of the embossing plate or paper. In this case, the pressure difference can be matched to yield a product having an equal amount of material over the surface area giving equally good product properties and appearance over the surface.

Heterogeneous scattering can be used to enrich the amount of material in the protruding parts of the structure, so as to make increased chemical and mechanical properties in those parts of the surface that are subjected to the most stress from walking and cleaning.

Heterogeneous scattering can also be used to introduce differences in pressure over the area during heat compressing in excess of what is granted from the structuration of the press plate or paper. In this case, depending on the control of the bulk fluidity of the powder mixture, color variation can be controlled.

By employing more than one powder mixture the heterogeneous scattering can have a specific formulation tailored for the application. If a protruding part should be protected, this part can be richer in resins and wear particles compared to the bulk of the product, thus saving cost of the formulation. If water resistance of a locking system area should be optimized a more hydrophobic powder mixture can be used. If a specific decorative effect is sought, the powder fluidity can be optimized to give big color variation. Choice of pigment or other design material in the heterogeneous scattering can also be used.

Control by mechanical design—Removal or surface mixing of part of the scattered powder layer by means of blowing, sucking, brushing, scraping, cutting or equivalent are also means to introduce difference of pressure over the area during heat compression. In this case, similar effects of color variation due to pressure differences can be obtained as described above for heterogonous scattering. In the case of two or more powder layers being scattered on the surface, the effect of the partial removal or mixing can be further enhanced by, for example, differences in composition of the powder layers. A local mixing, micro mixing, of powders will cause a gradient in colorations that is further enhanced by the provoked pressure difference giving a further gradient in shading of the differently colored surface. The result is a possibility to make very complex color variations over the surface.

Partial removal or surface mixing as well as inhomogeneous scattering can easily be made using robots in order to either make the design actions in a controlled or uncontrolled way so as to give either identical or individual designs.

The control methods above can be used to tailor the properties of the product. As an example, an increased wear resistance might be desired on parts of the surface.

A first aspect of the invention is a building panel comprising a decorative surface layer 5 connected to a core 6. The surface layer is a mix comprising fibres 14, colour substance preferably colour pigments, a binder and wear resistant particles 12. Furthermore the surface layer comprises lower parts and upper parts and there is preferably a binder concentration gradient between the lower parts and upper parts. In a preferred embodiment the lower parts comprise less binder than the upper parts. The binder is in a preferred embodiment a resin.

A reversed condition could also be used. Having higher binder content in the lower part gives a gradient of flow to both the board and the upper part that can make it possible to have a saturated surface area between the board and the lower part.

The surface layer preferably has a substantially homogenous distribution of the wear resistant particles throughout the thickness of the layer and wear resistant particles are present from the bottom, and thereby in contact with the core, to the top.

The surface layer may in one embodiment comprise a sub layer and a top layer. The sub layer may not include wear resistant particles and colour pigments. In this case the sub layer can be considered as a scattered core.

Preferred embodiments of the first aspect of the invention are disclosed under Detailed Description of Embodiments and in the dependent product claims below.

A second aspect of the invention is a method of manufacturing a building panel having a structured surface with a design that comprises colour variation in register with the structure whereby the method comprises the steps of:

applying a layer comprising a mix of fibres, binder, preferably a resin, wear resistant particles, preferably aluminium oxide, and a colour substance, preferably colour pigments, on a carrier wherein the mix is floatable under heat and pressure applying heat and pressure on the mix by a structured matrix comprising protrusions and cavities such that a controlled floating of the mix is obtained by the varying pressure distribution applied on the surface. In a preferred embodiment the resin content in the layer is adapted to the pressure such that a sufficient floating is obtained and preferably the binder is a resin and the weight content of the resin is at least 40% of the layer.

In order to increase the fluidity, the mass ratio between resins and fibres is preferably in the range of about 130-240%, more preferably in the range of 150-220%, most preferably in the range of about 180-200%. In the most preferred embodiment the mass ratio between resins and fibres is about 190%.

Preferred embodiments of the second aspect of the invention are disclosed under Detailed Description of Embodiments and in the dependent method claims below.

In order to increase the releasability, i.e., the ability to be released from and not stick to the press plate, a mass ratio between resins and the sum of the masses of the fibres and the coloring substances is preferably higher than about 60%, more preferably higher than about 100% and most preferably in the range of about 100-130%.

The layer in the method preferably has a substantially homogenous distribution of the wear resistant particles throughout the thickness of the layer and wear resistant particles are present from the bottom, and thereby in contact with the carrier, to the top.

Another aspect of the invention is to use the principles and control methods above to create a surface with even colour distribution and/or properties. In this case a layer with a fluidity, when the pressure is applied is used, that is sufficiently low, to maintain the substantially homogenous mix or substantially homogenous mix and distribution of the component in the layer. Such low fluidity can be obtained by having certain ratios between resins, fibres and pigments. One ratio could be calculated through dividing the mass of resins and the mass of fibres, this ratio is preferably less than about 90% and even more preferably less than about 80%. Another ratio could be between the mass of resins and the sum of the mass of fibres and the mass of coloring substances; this ratio is preferably higher than about 60% and in a preferred range of about 100-130%.

BRIEF DESCRIPTION OF THE DRAWINGS

The following disclosure will be described in connection to preferred embodiments and in greater detail with reference to the appended exemplary drawings, wherein FIG. 1 Illustrates a Wood Fibre Floor panel, and FIG. 2 Illustrates a Wood Fibre Floor panel with registered embossing according to one embodiment of the invention.

DETAILED DESCRIPTION OF EMBODIMENTS

Figure 1:
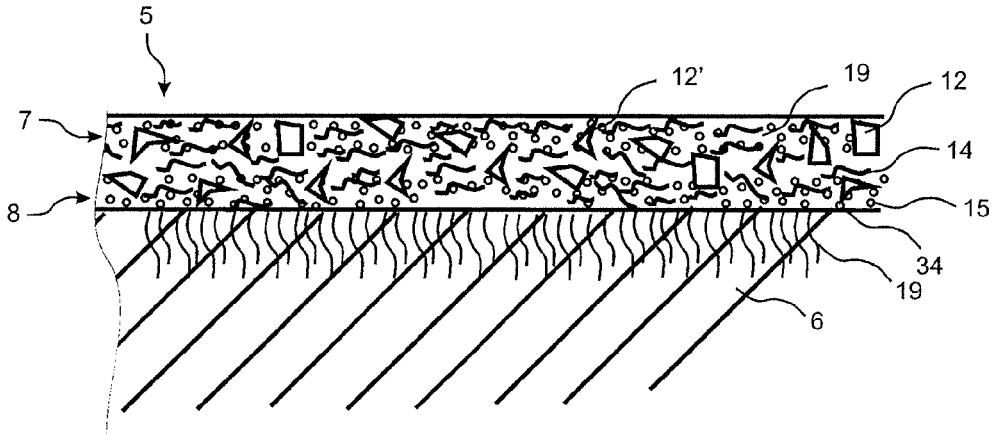

FIG. 1 shows a Wood Fibre Floor (WFF) panel of the type disclosed in WO 2009/065769, where the surface layer 5 has been formed on a core 6 that has been produced in a prior separate operation, for example a HDF panel. The surface layer comprises wood fibres 14, wear resistance particles 12 and a binder. The surface layer 5 includes an upper part 7 and a lower part 8. The surface layer may in one embodiment comprise a sub layer and a top layer. This sub layer could be produced in the same way as the top layer and the same material compositions could be used except for the fact that in some embodiments wear resistant particles and colour pigments are not included. In this case the sub layer can be considered as a scattered core.

Figure 2:
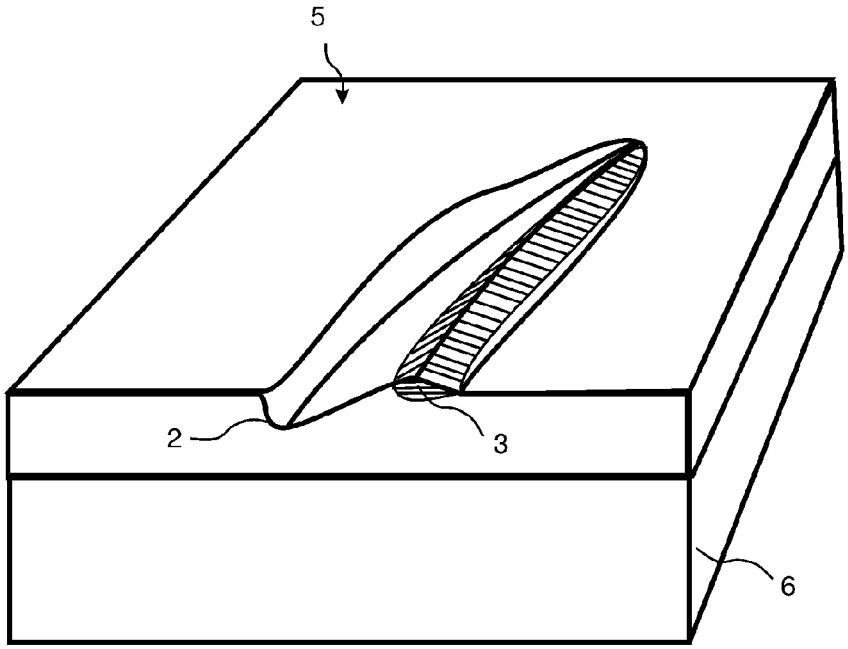

FIG. 2 shows one embodiment of a Wood Fibre Floor (WFF) panel according to the invention with colour variation 3 in register with the structure 2 of the surface layer 5.

Preferably the same scattering and pressing units as disclosed in WO 2009/065769 are used preferably together with a structured press plate in the method according to the invention. The panels according to the invention are preferably produced by this method.

In order to illustrate the effects of the parameters used in the control methods above, some examples are given below.

Examples 1-3 show the effect of changing the composition. Example 4 shows comparing with example 1 the effect of changing the pressure. The surface layer in Examples 1-4 is scattered in one layer. In Examples 5-6 the surface layer comprises a sub layer and a top layer. The surface layer is in all examples scattered on a HDF panel. Aluminium oxide is used as the wear resistant particles in all examples and the coloring substance is a pigment of Titanium Dioxide or combinations of Titanium Dioxide and Carbon Black.

EXAMPLE 1

High Structure, Normal Pressure
Scattered amount: 600 g/m2
Carrier board: 8 mm HDF
Backing: 2 layers of NKR 140
Structure plate: 0.7 mm Slate Structure
Pressure: 45 kg/cm2,
Contact time: 25 sec
Press plate temperature: 160° C.
One Surface Layer—Scattered Homogenously

| Component | Wt-% |
|---|---|
| Melamine Formaldehyde resin | 33 |
| Wood Fibre | 43 |
| Wear Resistant Particles: Aluminum Oxide | 13 |
| Coloring Substance: Titanium Dioxide | 11 |
| Sum | 100 |

The mass ratio between Melamine Formaldehyde Resin and dry components (Wood Fibre, Coloring Substance) is equal to 61%. The mass ratio between Melamine Formaldehyde Resin and Wood Fibre is equal to 77%. The resulting product is a homogenous off white product.

EXAMPLE 2

High Structure, Normal Pressure
Scattered amount: 600 g/m2
Carrier board: 8 mm HDF
Backing: 2 layers of NKR 140
Structure plate: 0.7 mm Slate Structure
Pressure: 45 kg/cm2,
Contact time: 25 sec
Press plate temperature: 160° C.
One Surface Layer—Scattered Homogenously

| Component | Wt-% |
|---|---|
| Melamine Formaldehyde resin | 47 |
| Wood Fibre | 25 |
| Wear Resistant Particles: Aluminum Oxide | 17 |
| Coloring Substance: Titanium Dioxide | 11 |
| Sum | 100 |

The mass ratio between Melamine Formaldehyde Resin and dry components (Wood Fibre, Coloring Substance) is equal to 131%. The mass ratio between Melamine Formaldehyde Resin and Wood Fibre is equal to 188%. The resulting product is a substantially homogenous off white product with some whiter spots at the ridges of the embossed structure.

EXAMPLE 3

High Structure, Normal Pressure
Scattered amount: 600 g/m2
Carrier board: 8 mm HDF
Backing: 2 layers of NKR 140
Structure plate: 0.7 mm Slate Structure
Pressure: 45 kg/cm2,
Contact time: 25 sec Press plate temperature: 160° C.
One Surface Layer—Scattered Homogenously

| Component | Wt-% |
|---|---|
| Melamine Formaldehyde resin | 65 |
| Wood Fibre | 17 |
| Wear Resistant Particles: Aluminum Oxide | 11 |
| Coloring Substance: Titanium Dioxide | 7 |
| Sum | 100 |

The mass ratio between Melamine Formaldehyde Resin and dry components (Wood Fibre, Coloring Substance) is equal to 271%. The mass ratio between Melamine Formaldehyde Resin and Wood Fibre is equal to 382%. The resulting product is a substantially homogenous off white product with many whiter spots at the ridges of the embossed structure.

EXAMPLE 4

High Structure, High Pressure
Scattered amount: 600 g/m2
Carrier board: 8 mm HDF
Backing: 2 layers of NKR 140
Structure plate: 0.7 mm Slate Structure
Pressure: 60 kg/cm2,
Contact time: 25 sec
Press plate temperature: 160° C.
One Surface Layer—Scattered Homogenously.

| Component | Wt-% |
|---|---|
| Melamine Formaldehyde resin | 47 |
| Wood Fibre | 25 |
| Wear Resistant Particles: Aluminum Oxide | 17 |
| Coloring Substance: Titanium Dioxide | 11 |
| Sum | 100 |

The resulting product is a substantially homogenous off white product with many whiter spots at the ridges of the embossed structure. The mass ratio between Melamine Formaldehyde Resin and dry components (Wood Fibre, Coloring Substance) is equal to 131%. The mass ratio between Melamine Formaldehyde Resin and Wood Fibre is equal to 188%.

EXAMPLE 5

Heterogeneous Scattering
Scattered amount: 300+300 g/m2
Carrier board: 8 mm HDF
Backing: 2 layers of NKR 140
Structure plate: 0.7 mm Slate Structure
Pressure: 45 kg/cm2,
Contact time: 25 sec
Press plate temperature: 160° C.
Sub Layer Formulation—Scattered Homogenously.

| Component | Wt-% |
|---|---|
| Melamine Formaldehyde resin | 42.2 |
| Wood Fibre | 28.2 |
| Wear Resistant Particles: Aluminum Oxide | 25.8 |
| Coloring Substance: Titanium Dioxide | 3.5 |
| Coloring Substance: Carbon Black | 0.3 |
| Sum | 100 |

The mass ratio between Melamine Formaldehyde Resin and dry components (Wood Fibre, Coloring Substance) is equal to 132%. The mass ratio between Melamine Formaldehyde Resin and Wood Fibre is equal to 150%.
Top Layer Formulation—Scattered through a Shablon.

| Component | Wt-% |
|---|---|
| Melamine Formaldehyde resin | 49.5 |
| Wood Fibre | 40 |
| Wear Resistant Particles: Aluminum Oxide | 10 |
| Coloring Substance: Carbon Black | 0.5 |
| Sum | 100 |

The mass ratio between Melamine Formaldehyde Resin and dry components (Wood Fibre, Coloring Substance) is equal to 122%. The mass ratio between Melamine Formaldehyde Resin and Wood Fibre is equal to 124%. The resulting product is a dark grey product with a black pattern. In the more deeply embossed regions the black color is more intense compared to the more shallow regions.

EXAMPLE 6

Mechanical Design
Scattered amount: 300 g/m2 Sub layer+300 g/m2 Top Layer
Carrier board: 8 mm HDF
Backing: 2 layers of NKR 140
Structure plate: 0.7 mm Slate Structure
Pressure: 60 kg/cm2,
Contact time: 25 sec
Press plate temperature: 160° C.
Sub Layer Formulation—Scattered Homogenously.

| Component | Wt-% |
|---|---|
| Melamine Formaldehyde resin | 47.5 |
| Wood Fibre | 24.5 |

-continued

| Component | Wt-% |
|---|---|
| Wear Resistant Particles: Aluminium Oxide | 17.5 |
| Coloring Substance: Titanium Dioxide | 10.5 |
| Sum | 100 |

The mass ratio between Melamine Formaldehyde Resin and dry components (Wood Fibre,
Coloring Substance) is equal to 136%. The mass ratio between Melamine Formaldehyde Resin and Wood Fibre is equal to 194%.
Top Layer Formulation—Scattered Homogenously

| Component | Wt-% |
|---|---|
| Melamine Formaldehyde resin | 49.5 |
| Wood Fibre | 40 |
| Wear Resistant Particles: Aluminium Oxide | 10 |
| Coloring Substance: Carbon Black | 0.5 |
| Sum | 100 |

The mass ratio between Melamine Formaldehyde Resin and dry components (Wood Fibre, Coloring Substance) is equal to 122%. The mass ratio between Melamine Formaldehyde Resin and Wood Fibre is equal to 124%.

After scattering of the sub layer and the top layer, a robot scratched the surface in a programmed way to remove part of the top layer.

The resulting product is a black surface having a grey-white decoration according to the action of the robot.

The invention claimed is:

1. A building panel comprising a decorative surface layer arranged on a core wherein
the surface layer comprises a lower part and an upper part disposed above the lower part with a binder concentration gradient between the lower part and the upper part;
the lower part of the surface layer comprises a first mix comprising fibres, coloring substance, a binder, and wear resistance particles; and
the upper part of the surface layer comprises a second mix comprising the fibres, the coloring substance, the binder, and the wear resistance particles;
wherein the first mix possesses a first homogenous binder concentration, and
wherein the second mix possesses a second homogenous binder concentration not equal to the first homogenous binder concentration.

2. The building panel according to claim 1, wherein the lower part comprises less binder than the upper part.

3. The building panel according to claim 1, wherein the upper part comprises less binder than the lower part.

4. The building panel according to claim 1, wherein the binder is a melamine resin.

5. The building panel according to claim 1, wherein the fibres are wood fibres.

6. The building panel according to claim 1, wherein the panel is a floor panel.

7. A building panel produced according to a method of manufacturing a building panel having an evenly colored surface whereby the method comprises the steps of:
applying a layer comprising a mix of fibres, binder, wear resistant particles, and a coloring substance, on a carrier wherein the mix is floatable under heat and pressure; and applying heat and pressure on the mix, wherein the mass ratio between the binder and fibres is less than about 90%, wherein the layer comprises an upper part comprising a first mix of the fibres, the binder, the wear resistant particles, and the coloring substance, and the layer comprises a lower part comprising a second mix of the fibres, the binder, the wear resistant particles, and the coloring substance, the upper part being disposed above the lower part, wherein the first mix possesses a first homogenous binder concentration, and wherein the second mix possesses a second homogenous binder concentration not equal to the first homogenous binder concentration.

8. The building panel according to claim 1, wherein the weight content of the binder is at least 40% of the surface layer.

9. The building panel according to claim 1, wherein the binders in the mix of the upper part and the lower part of the surface layer are provided in a powder form.

10. The building panel according claim 1, wherein the surface layer has a substantially homogenous distribution of the wear resistant particles throughout a thickness of the surface layer.

11. The building panel according to claim 1, wherein the mass ratio between the binder and the fibres is in the range of 130-240%.

12. The building panel according to claim 1, wherein the mass ratio between the binder and the fibres is in the range of 180-200%.

13. The building panel according to claim 7, wherein the mass ratio between the binder and the sum of the mass of the fibres and the coloring substance is in the range of 100-130%.

14. A building panel comprising a decorative surface layer arranged on a core wherein the surface layer comprises two mixes, a first mix comprising fibres, coloring substance, a binder and wear resistant particles, and a second mix comprising fibres, coloring substance, a binder and wear resistant particles, wherein the first mix is applied on the second mix causing the first mix to be disposed above the second mix in the surface layer, and wherein a homogenous binder concentration of the first mix is different than a homogenous binder concentration of the second mix.

15. The building panel according to claim 14, wherein the content of binder in the first mix is less than the content of binder in the second mix.

16. The building panel according to claim 14, wherein the content of binder in the second mix is less than the content of binder in the first mix.

17. A building panel comprising a decorative surface layer connected to a core wherein the surface layer is a mix comprising fibres, coloring substance, a binder and wear resistant particles, and wherein the surface layer comprises a lower part and an upper part disposed above the lower part with a binder concentration gradient between the lower part and the upper part;

the lower part of the surface layer comprising a first mix having a first homogenous binder concentration; and the upper part of the surface layer comprising a second mix having a second homogenous binder concentration not equal to the first homogenous binder concentration.

18. The building panel according to claim 17, wherein the content of binder in the first mix is less than the content of binder in the second mix.

19. The building panel according to claim 17, wherein the content of binder in the second mix is less than the content of binder in the first mix.

* * * * *